US008780032B2

(12) United States Patent
Lee et al.

(10) Patent No.: US 8,780,032 B2
(45) Date of Patent: Jul. 15, 2014

(54) DISPLAY PANEL AND DISPLAY APPARATUS HAVING THE SAME

(71) Applicant: Samsung Display Co., Ltd., Yongin (KR)

(72) Inventors: Min-Cheol Lee, Seoul (KR); Hee-Bum Park, Seongnam-si (KR); Yong-Soon Lee, Cheonan-si (KR); Seung-Soo Baek, Seoul (KR); Sang-Jin Jeon, Suwon-si (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 14/053,229

(22) Filed: Oct. 14, 2013

(65) Prior Publication Data

US 2014/0043308 A1 Feb. 13, 2014

Related U.S. Application Data

(63) Continuation of application No. 11/999,329, filed on Dec. 4, 2007, now Pat. No. 8,558,776.

(30) Foreign Application Priority Data

Dec. 4, 2006 (KR) ..... 10-2006-0121277

(51) Int. Cl.
*G09G 3/36* (2006.01)

(52) U.S. Cl.
USPC ..... 345/98; 345/206

(58) Field of Classification Search
CPC ..... G09G 2300/0408; G09G 2300/0421; G09G 2300/0426; G09G 2310/0281
USPC ..... 345/206, 98
See application file for complete search history.

(56) References Cited

U.S. PATENT DOCUMENTS

| | | | | |
|---|---|---|---|---|
| 5,206,634 | A | 4/1993 | Matsumoto et al. | |
| 6,256,004 | B1 | 7/2001 | Izumi et al. | |
| 6,476,789 | B1 | 11/2002 | Sakaguchi et al. | |
| 2004/0084675 | A1 * | 5/2004 | Koyama et al. | 257/66 |
| 2004/0090583 | A1 | 5/2004 | Yu | |
| 2004/0119675 | A1 | 6/2004 | Washio et al. | |
| 2004/0222981 | A1 | 11/2004 | Kobayashi et al. | |
| 2004/0227715 | A1 * | 11/2004 | Yamazaki | 345/98 |
| 2005/0012706 | A1 | 1/2005 | Murade | |
| 2006/0092121 | A1 | 5/2006 | Watanabe et al. | |

FOREIGN PATENT DOCUMENTS

KR 1020060115817 A 11/2006

* cited by examiner

*Primary Examiner* — Kevin M Nguyen
(74) *Attorney, Agent, or Firm* — Innovation Counsel LLP

(57) ABSTRACT

In a display panel and a display apparatus having the display panel, the display panel includes array and opposite substrates. The array substrate includes display and peripheral areas. Gate and source lines are formed in the display area. A gate driving part and first and second clock lines are formed in the peripheral area. The gate driving part outputs gate signals to the gate line. The first and second clock lines respectively transmit first and second clock signals to the gate driving part. The opposite substrate is combined with the array substrate and includes a common electrode layer. The common electrode layer has an opening portion patterned to expose the first and second clock lines. The exposed portions of the first and second clock lines have substantially the same area. Thus, delays of the gate signals may be minimized and distortion of the gate signals may be prevented.

12 Claims, 5 Drawing Sheets

<τ=R · C>

DISPLAY PANEL AND DISPLAY APPARATUS HAVING THE SAME

CROSS-REFERENCE TO RELATED APPLICATIONS

This application is a continuation application of U.S. application Ser. No. 11/999,329, filed on Dec. 4, 2007, which application claims priority under 35 U.S.C. §119 of Korean Patent Application No. 10-2006-121277, filed on Dec. 4, 2006 in the Korean Intellectual Property Office (KIPO), the contents of each of which are herein incorporated by reference in their entirety.

BACKGROUND OF THE INVENTION

1. Field of the Invention

The present invention relates to a display panel and a display apparatus having the display panel. More particularly, the present invention relates to a display panel capable of decreasing horizontal line defects and the display apparatus having the display panel.

2. Description of the Related Art

Generally, a liquid crystal display (LCD) apparatus includes an LCD panel, a printed circuit board (PCB) on which a driving chip that drives the LCD panel is mounted, source tape carrier packages (TCPs) on each of which a source driving chip is mounted, and gate TCPs on each of which a gate driving chip is mounted. The source TCPs electrically connect the LCD panel with the PCB.

A gate-IC-less structure has been developed and applied to decrease the size and manufacturing costs of the LCD apparatus. In the gate-IC-less structure, the gate TCPs are removed and the gate driving circuit is directly formed on the LCD panel.

In addition, a horizontal pixel structure has been applied to decrease the number of the source driving chips. The pixels having different colors are connected to one source line in the horizontal pixel structure. In the horizontal pixel structure, a relatively longer side of each of red, green and blue pixels is formed along a horizontal direction, and a relatively shorter side of each of red, green and blue pixels is formed along a vertical direction, so that the red, green and blue pixels are arranged along the vertical direction. In the horizontal pixel structure, the red, green and blue pixels are connected to the same source line and are respectively driven for one-third of one horizontal period (1H), so that the number of the source lines may be decreased to one third of the number previously required, and the number of the source driving chips may also be decreased.

When the number of the source driving chips is decreased, the length of a signal line that transmits a control signal to a gate driving circuit is increased, so that the signal may be distorted. In this case, the control signal is transmitted through the TCP on which an outermost source driving chip is mounted. Accordingly, the gate signals applied to the gate line may be distorted, and thus a horizontal line defect may occur on a display screen.

SUMMARY OF THE INVENTION

The present invention provides a display panel for enhancing display quality.

The present invention also provides a display apparatus having the display panel.

In an exemplary display panel according to the present invention, the display panel includes an array substrate and an opposite substrate. The array substrate includes a display area and a peripheral area. Gate and source lines are formed in the display area. A gate driving part and first and second clock lines are formed in the peripheral area. The gate driving part outputs gate signals to the gate line. The first and second clock lines respectively transmit first and second clock signals to the gate driving part. The opposite substrate is combined with the array substrate and includes a common electrode layer. The common electrode layer has an opening portion patterned to expose the first and second clock lines. The exposed portions of the first and second clock lines have substantially a same area.

In an exemplary display apparatus according to the present invention, the display apparatus includes a display panel, a source tape carrier package (TCP) and a source printed circuit board (PCB). The display panel includes a display area and a peripheral area. Gate and source lines are formed in the display area. A gate driving part and first and second clock lines are formed in the peripheral area. The gate driving part outputs gate signals to the gate line. The first and second clock lines respectively transmit first and second clock signals each having substantially a same time constant to the gate driving part. A source driving chip, that outputs a data signal to the source lines, is mounted on the source TCP. The source TCP includes dummy terminals electrically connected to the first and second clock lines to receive the first and second clock signals. The source PCB is electrically connected to the display panel through the source TCP.

Pixels having different colors are connected to the source line, and a relatively longer side of each pixel is aligned in an extended direction of the gate line and a relatively shorter side of each pixel is aligned in an extended direction of the source line.

The gate driving part includes a first gate driving part formed in a first peripheral area that is adjacent to a first end portion of the gate line, to output the gate signals to the gate line, and a second gate driving part formed in a second peripheral area that is adjacent to a second end portion of the gate line, to output the gate signals to the gate line.

The display panel includes an array substrate having the first and second clock lines formed thereon, and an opposite substrate having a common electrode layer formed thereon and facing the array substrate. The common electrode layer includes an opening portion patterned corresponding to an area in which the first and second clock lines are formed, and each area of the first and second clock lines exposed through the opening portion is substantially the same.

The display apparatus further includes a sealant formed around the array substrate to combine the array substrate with the opposite substrate. Areas of the first and second clock lines that are covered by the sealant are substantially the same.

End portions of the first and second clock lines respectively further include first and second pad electrodes on which the dummy terminals are mounted. Areas of the first and second pad electrodes are substantially same. Preferably, the numbers of the dummy terminals assigned to each of the first and second pad electrodes are substantially same.

The display apparatus further includes a main PCB electrically connected to the source PCB through a flexible PCB (FPCB), and having a main driving circuit that is mounted on the main PCB and outputs the first and second clock signals. The main PCB includes first and second resistance elements formed on the main PCB. The first and second resistance elements are electrically connected to first and second output terminals of the main driving circuit outputting the first and second clock signals, respectively. The first and second resistance elements compensate for a time constant difference between the first and second clock signals. Preferably, the first and second resistance elements are variable resistors.

According to the present invention, the time constants of the first and second clock signals that are control signals of the gate driving part become substantially same, so that delays of the gate signals may be minimized and distortion of the gate signals may be prevented.

BRIEF DESCRIPTION OF THE DRAWINGS

The above and other features and advantages of the present invention will become more apparent in view of the following detailed description of exemplary embodiments thereof taken with reference to the accompanying drawings, in which.

DESCRIPTION OF THE EMBODIMENTS

Figure 1:
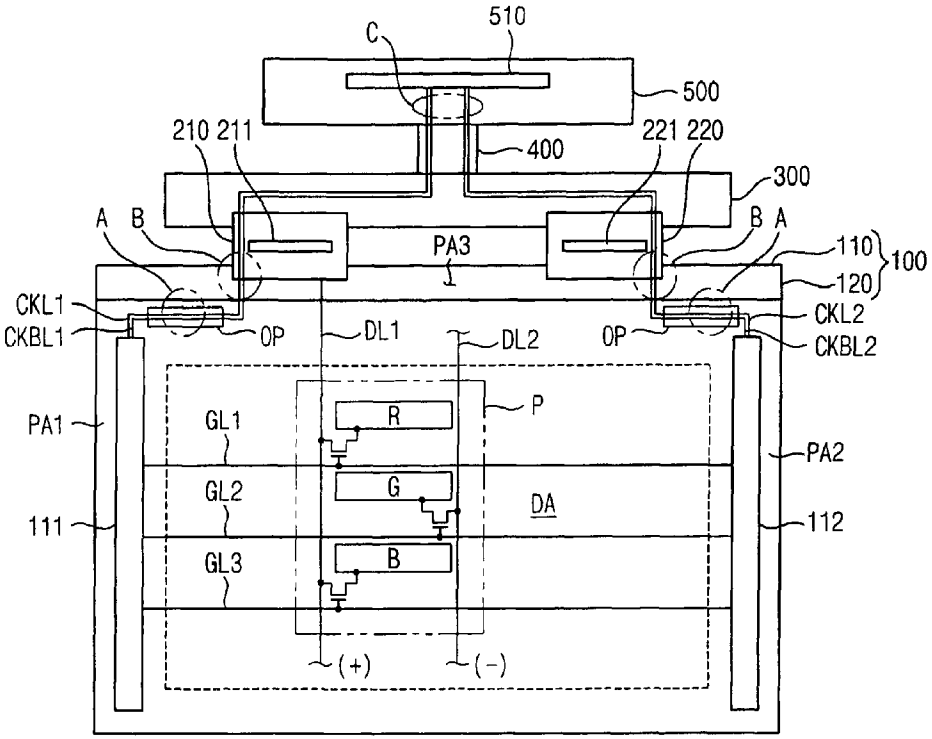
FIG. 1 is a plan view illustrating a display apparatus according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

FIG. 1 is a plan view illustrating a display apparatus according to an exemplary embodiment of the present invention.

Referring to FIG. 1, the display apparatus according to the present exemplary embodiment includes a display panel 100, a plurality of source tape carrier packages (TCPs) 210 and 220, a source printed circuit board (PCB) 300, a flexible PCB (FPCB) 400 and a main PCB 500.

The display panel 100 includes two substrates facing each other, specifically, an array substrate 110 and an opposite substrate 120, and a liquid crystal layer disposed between the two substrates. The display panel 100 includes a plurality of gate lines GL1, GL2 and GL3 extending along a first direction, and a plurality of source lines DL1 and DL2 extending along a second direction substantially perpendicular to the first direction. The display panel 100 is divided into a display area DA and a peripheral area that includes first, second and third peripheral areas PA1, PA2 and PA3 bordering the display area and the gate lines GL1, GL2 and GL3 and the source lines DL1 and DL2. Unit pixel portions P that are arranged in a matrix shape are defined in the display area DA, and the first, second and third peripheral areas PA1, PA2 and PA3 enclose the display area DA.

Each of the unit pixel portions P includes pixels having different colors. For example, the unit pixel portion P includes a first pixel R having a red color, a second pixel G having a green color and a third pixel B having a blue color. The first, second and third pixels R, G and B each include a switching element that is connected to gate lines GL1, GL2 and GL3, respectively.

A relatively longer side of each of the first, second and third pixels R, G and B is aligned in the first direction, for example a horizontal direction, and a relatively shorter side of each of the first, second and third pixels R, G and B is aligned in the second direction, for example a vertical direction. The unit pixel portion P has a structure in which the first, second and third pixel portions R, G and B are arranged along the second direction.

For example, in the display panel 100, the pixels aligned along vertical lines and formed between adjacent source lines DL1 and DL2 are sequentially connected to adjacent source lines DL1 and DL2. A positive (+) data voltage and a negative (−) data voltage inverted with respect to a reference voltage are applied to adjacent source lines DL1 and DL2, according to a column inversion process. Accordingly, the pixels in a column are sequentially connected to adjacent source lines to which the positive (+) and negative (−) data voltages are applied, so that the pixels may obtain a dot inversion effect according to the column inversion process.

First and second gate driving parts 111 and 112, configured for outputting gate signals, are respectively disposed in the first peripheral area PA1 and the second peripheral area PA2. The first and second gate driving parts 111 and 112 are respectively connected to the one end of the gate line and the other end of the gate line and output the gate signals at the same time. For example, a dual process applying the gate signals at both ends of the gate line is used. Each of the gate signals is applied via the dual process, so that delays of the signal due to line resistance may be minimized to prevent display defects due to signal distortion.

The source TCPs 210 and 220 are mounted on the third peripheral area PA3. First and second clock lines CKL1 and CKBL1 that respectively transmit first and second clock signals CK1 and CKB1 from the main PCB 500 to the first gate driving part 111 are formed in part in the third peripheral area PA3. Third and fourth clock lines CKL2 and CKBL2 that respectively transmit third and fourth clock signals CK2 and CKB2 from the main PCB 500 to the second gate driving part 112 are formed in part in the third peripheral area PA3.

A first source driving chip 211 that outputs data voltages to a first group of source lines is mounted on the first source TCP 210. A first end portion of the first source TCP 210 is electrically connected to the source PCB 300, and a second end portion of the first source TCP 210 is electrically connected to pads (not shown) formed in the third peripheral area PA3.

A second source driving chip 221 that outputs data voltages to a second group of source lines is mounted on the second source TCP 220. A first end portion of the second source TCP 220 is electrically connected to the source PCB 300 and a second end portion of the second source TCP 220 is electrically connected to pads (not shown) formed in the third peripheral area PA3.

First dummy terminals (not shown) of the first source TCP 210 are electrically connected to the first and second clock lines CKL1 and CKBL1, and second dummy terminals (not shown) of the second source TCP 220 are electrically connected to the third and fourth clock lines CKL2 and CKBL2.

In this case, the first and second clock lines CKL1 and CKBL1 are designed to have substantially the same line resistance, so that the first and second clock signals CK1 and CKB1 having substantially the same time constant are transmitted. In addition, the third and fourth clock lines CKL2 and CKBL2 are designed to have substantially the same line resistance, so that the third and fourth clock signals CK2 and CKB2 having substantially the same time constant are transmitted. Accordingly, the first, second, third and fourth clock lines CKL1, CKBL1, CKL2 and CKBL2 are designed to have substantially the same line resistance.

Firstly, the first and second clock lines CKL1 and CKBL1 are designed to have substantially the same line capacitance, and secondly, the first and second clock lines CKL1 and CKBL1 are designed to have substantially the same line resistance, so that the first and second clock lines CKL1 and CKBL1 have substantially the same RC time constant.

The source PCB 300 is electrically connected to the first and second TCPs 210 and 220, and is electrically connected to the main PCB 500 through the FPCB 400.

A main driving circuit 510 is mounted on the main PCB 500. The first, second, third and fourth clock signals CK1, CKB1, CK2 and CKB2 are outputted from the main driving circuit 510. The first and second clock lines CKL1 and CKBL1 are substantially symmetrically formed in the main PCB 500 to have substantially the same resistance in the display panel 100. In addition, resistance elements C that compensate for a time constant difference between the first and second clock signals CK1 and CKB1 due to errors in a manufacturing process, are formed on the main PCB 500.

Figure 2A:
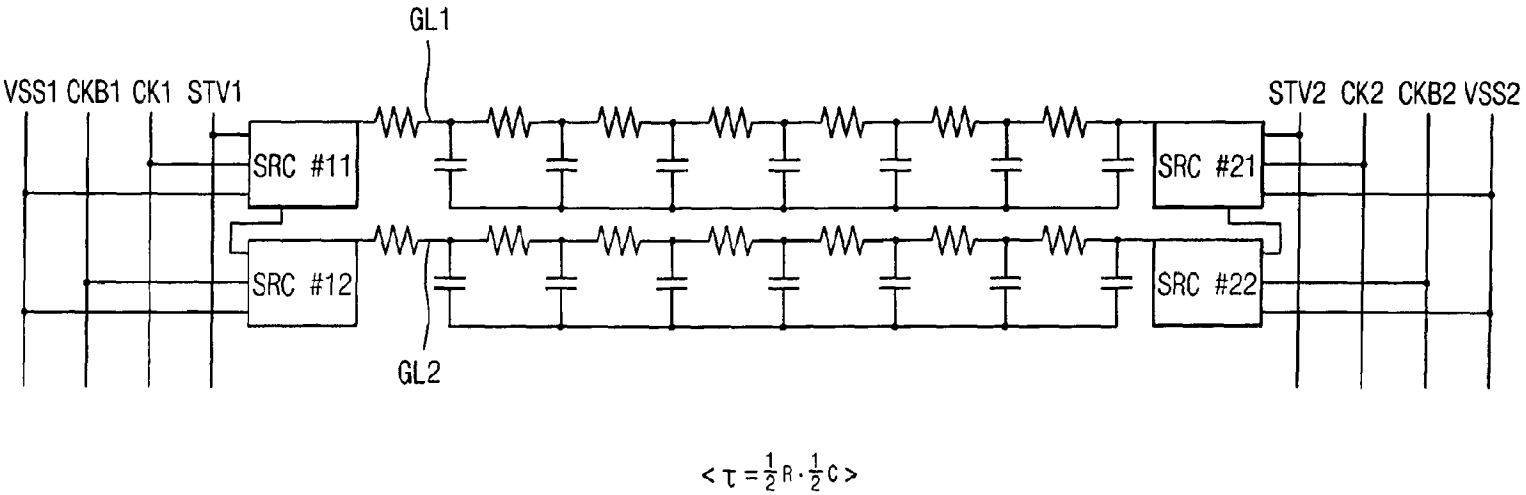
FIG. 2A is an equivalent circuit diagram of a portion of a display panel according to the exemplary embodiment shown in FIG. 1.
Figure 2B:
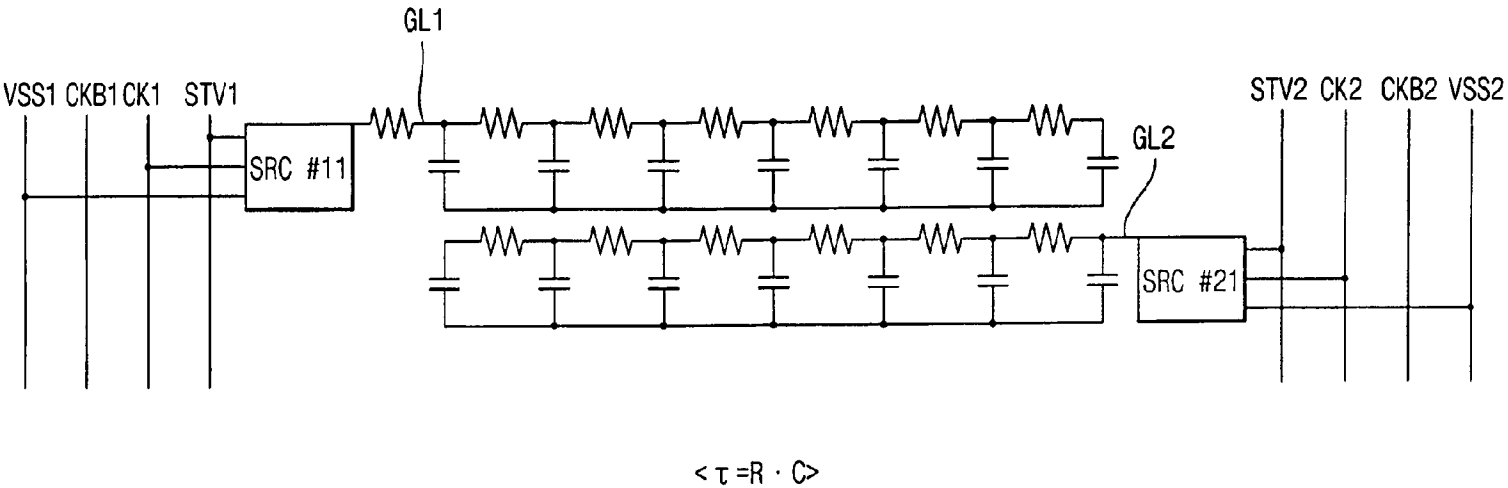
FIG. 2B is an equivalent circuit diagram of a portion of a display panel in accordance with another exemplary embodiment of the present invention.

FIG. 2A is an equivalent circuit diagram of a portion of the display panel in accordance with the exemplary embodiment of the invention shown in FIG. 1. FIG. 2B is an equivalent circuit diagram of a portion of a display panel in accordance with another exemplary embodiment of the present invention.

Referring to FIGS. 1 and 2A, the display panel includes one shift register in which a plurality of stages of each of the first and second gate driving parts 111 and 112 are dependently connected with each other.

The first gate driving part 111 is connected to a first end portion of the gate lines to output the gate signals, and the second gate driving part 112 is connected to a second end portion of the gate lines to output the gate signals.

The first gate driving part 111 is driven by a first off-voltage VSS1, the first clock signal CK1, the second clock signal CKB1 and a first start signal STV1. The first off-voltage VSS1 determines a low level of the gate signals. The first clock signal CK1 determines a high level of odd-numbered gate signals. The second clock signal CKB1 determines a high level of even-numbered gate signals. The first start signal STV1 controls a start of the first gate driving part 111.

The second gate driving part 112 is driven by a second off-voltage VSS2, the third clock signal CK2, the fourth clock signal CKB2 and a second start signal STV2. The second off-voltage VSS2 determines a low level of the gate signals. The third clock signal CK2 determines a high level of odd-numbered gate signals. The fourth clock signal CKB2 determines a high level of even-numbered gate signals. The second start signal STV2 controls a start of the second gate driving part 112.

For example, a first stage SRC11 of the first gate driving part 111 is connected to a first end portion of the first gate line GL1, and a first stage SRC21 of the second gate driving part 112 is connected to a second end portion of the first gate line GL1, to output the gate signals at the same time. In addition, a second stage SRC12 of the first gate driving part 111 is connected to a first end portion of the second gate line GL2, and a second stage SRC22 of the second gate driving part 112 is connected to a second end portion of the second gate line GL2, to output the gate signals at the same time.

The first and second gate driving parts illustrated in FIG. 2B, respectively output the gate signals to the odd-numbered and even-numbered gate lines. For example, the first stage SRC11 of the first gate driving part outputs the gate signals to the first gate line GL1. The first stage SRC21 of the second gate driving part outputs the gate signals to the second gate line GL2.

For example, as illustrated in FIG. 2B, when the gate signals are applied to the first end portion of the gate line, the time constant $\tau$ of the gate signals is RC. R is a line resistance and C is a line capacitance. However, when the gate signals are applied to both end portions of the gate line, as illustrated in FIG. 2A, the time constant $\tau$ of the gate signals is 1/4RC.

Accordingly, as illustrated in FIG. 2A, the gate signals are applied to both end portions of the gate line, so that the delays of the signal due to the line resistance may be minimized.

Figure 3A:
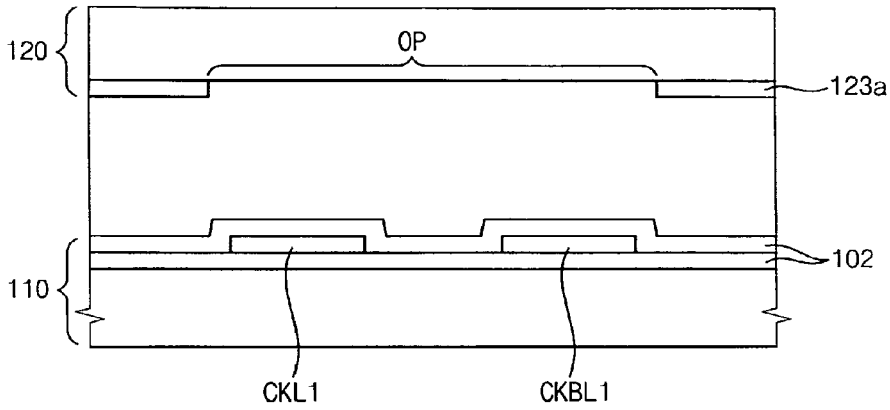
FIGS. 3A and 3B are cross-sectional views showing a portion "A" of FIG. 1.
Figure 3B:
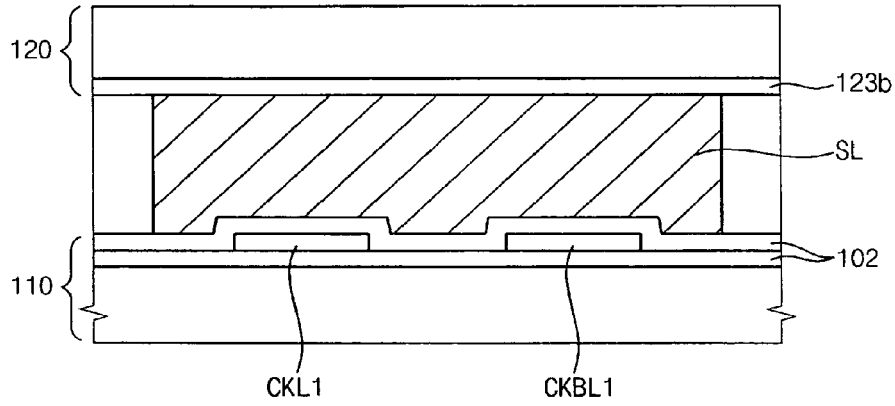

FIGS. 3A and 3B are cross-sectional views showing a portion "A" of FIG. 1.

Referring to FIGS. 1 and 3A, the first and second clock lines CKL1 and CKBL1 are formed on the array substrate 110. The first and second clock lines CKL1 and CKBL1 in particular are formed on the array substrate 110 with a metal layer. The widths and lengths of the first and second clock lines CKL1 and CKBL1 are controlled, so that the first and second clock lines CKL1 and CKBL1 have substantially the same line resistance. An insulating layer 102 is formed under and on the first and second clock lines CKL1 and CKBL1. A common electrode layer 123*a* is formed on an opposite substrate 120 facing the array substrate 110. The common electrode layer 123*a* includes patterned layer of a transparent conductive material.

In this case, the common electrode layer 123*a* is patterned to be equally applied to the first and second clock lines CKL1 and CKBL1. An area of the common electrode layer 123*a* corresponding to the first and second clock lines CKL1 and CKBL1 is equally opened or equally covered. For example, as illustrated in FIG. 3A, the common electrode layer 123*a* includes an opening portion OP corresponding to the first and second clock lines CKL1 and CKBL1. The opening portion OP exposes an area of each of the first and second clock lines CKL1 and CKBL1. The areas of the first and second clock lines CKL1 and CKBL1 exposed through the opening portion OP are substantially the same. Accordingly, the capacitances of the first and second clock lines CKL1 and CKBL1 may be minimized.

Referring to FIGS. 1 and 3B, the first and second clock lines CKL1 and CKBL1 are formed on the array substrate 110. A common electrode layer 123*b* is formed on the opposite substrate 120. A sealant SL is formed around the array substrate 110 to combine the array substrate 110 with the opposite substrate 120.

The sealant SL covers the first and second clock lines CKL1 and CKBL1. In this case, the sealant SL is formed in the third peripheral area PA3, so that each overlapping area of the sealant SL respectively overlapping with the first and second clock lines CKL1 and CKBL1 is substantially the same.

An opening portion OP is formed through the common electrode layer 123*a* as illustrated in FIG. 3A, and the sealant SL covers the first and second clock lines CKL1 and CKBL1 as illustrated in FIG. 3B, so that each capacitance of the first and second clock lines CKL1 and CKBL1 may be minimized and may be substantially the same.

Accordingly, each capacitance of the first and second clock lines CKL1 and CKBL1 may be substantially the same. Although not shown in the figures, each capacitance of the third and fourth clock lines CKL2 and CKBL2 may likewise be substantially the same, the configuration of clock lines CKL2 and CKBL2 being substantially the same as described above with regard to clock lines CKL1 and CKBL1.

Figure 4:
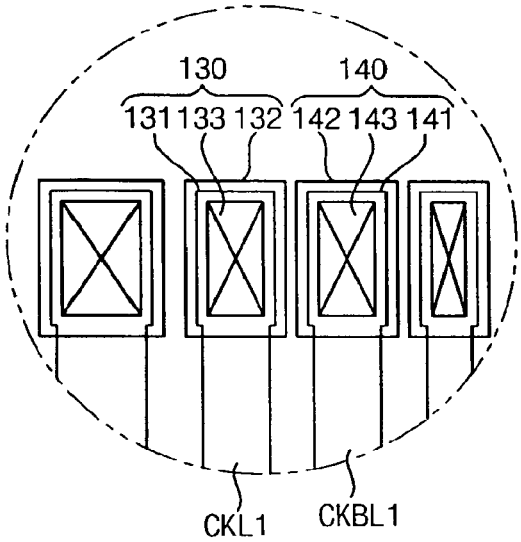
FIG. 4 is an enlarged plan view showing a portion "B" of FIG. 1.

FIG. 4 is an enlarged plan view showing a portion "B" of FIG. 1.

Referring to FIGS. 1 and 4, the first and second clock lines CKL1 and CKBL1 respectively include first and second pad portions 130 and 140 formed on the array substrate 110.

The first pad portion 130 includes a first end portion 131 of the first clock line CKL1, a first contact hole 133 exposing the first end portion 131 by removing the insulating layer, and a first pad electrode 132 making contact with the first end portion 131 through the first contact hole 133.

The second pad portion 140 includes a second end portion 141 of the second clock line CKBL1, a second contact hole 143 exposing the second end portion 141 by removing the insulating layer, and a second pad electrode 142 making contact with the second end portion 141 through the second contact hole 143 and having substantially the same area as the first pad electrode 132.

For example, the number of output terminals (not shown) of the first source TCP 210 assigned to the first pad portion 130 is substantially same as the number of the output terminals of the first source TCP 210 assigned to the second pad portion 140. When the number of the output terminals assigned to the first pad portion 130 is different from that assigned to the second pad portion 140, the first and second pad electrodes 132 and 142 may have substantially the same area. For example, when four output terminals of the first source TCP 210 are assigned to the first clock line CKL1 and five output terminals are assigned to the second clock line CKBL1, the first and second pad electrodes 132 and 142 may have substantially the same size. For example, the first and second pad electrodes 132 and 142 correspond to a total size of four output terminals.

Each area of the first and second pad portions 130 and 140 is substantially the same, so that each contact resistance of the first and second clock lines CKL1 and CKBL1 is substantially the same.

Although not shown in FIG. 4, the third and fourth clock lines CKL2 and CKBL2 may have pad portions that are substantially the same as the pad portions 130 and 140 and hence have substantially the same contact resistance.

Figure 5:
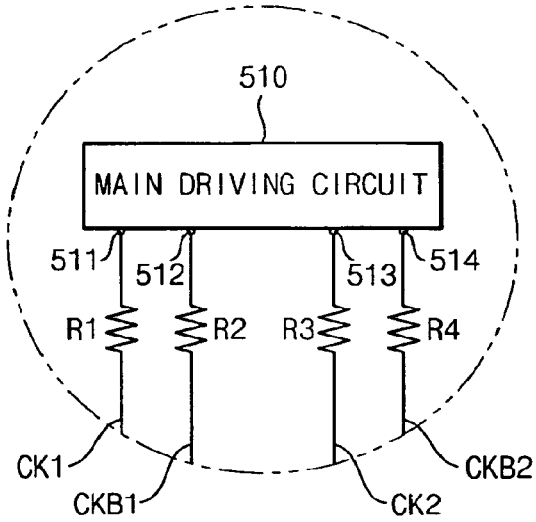
FIG. 5 is an enlarged plan view showing a portion "C" of FIG. 1.

FIG. 5 is an enlarged plan view showing a portion "C" of FIG. 1.

Referring to FIGS. 1 and 5, the main driving circuit 510 includes a first output terminal 511 through which the first clock signal CK1 is outputted, a second output terminal 512 through which the second clock signal CKB1 is outputted, a third output terminal 513 through which the third clock signal CK2 is outputted and a fourth output terminal 514 through which the fourth clock signal CKB2 is outputted.

First and second resistance elements R1 and R2 are respectively connected to the first and second output terminals 511 and 512. The first and second resistance elements R1 and R2 each have a resistance value to compensate for a time constant difference between the first and second clock signals CK1 and CKB1 occurring on the display panel 100.

As explained above, the first and second clock lines CKL1 and CKBL1 are formed on the display panel 100 to have substantially the same line resistance. For example, the length, the width, the contact resistance and so on may be substantially the same. In addition, the line capacitances may be substantially the same. For example, effects due to the pattern and the sealant formed on the opposite substrate 120 may be substantially the same.

Although the first and second clock lines CKL1 and CKBL1 formed on the display panel 100 have substantially the same line resistance and the same line capacitance, errors in a manufacturing process may cause a time constant difference between the first and second clock signals CK1 and CKB1.

The first and second resistance elements R1 and R2 are directly connected to the first and second output terminals 511 and 512 of the main driving circuit 510 to compensate for the time constant difference. In the same way, the third and fourth resistance elements R3 and R4 are directly connected to the third and fourth output terminals 513 and 514, to compensate for a time constant difference between the third and fourth clock signals CK2 and CKB2.

For example, the first, second, third and fourth resistance elements R1, R2, R3 and R4 are designed to be variable resistors, to compensate for the time constant differences between the first and second clock signals, and the third and fourth clock signals.

According to the present invention, a gate driving circuit has a dual structure, and first and second clock signals CK and CKB that are control signals of the gate driving circuit have substantially the same time constant, so that delays of gate signals may be minimized and distortion of the gate signals may be prevented. First and second clock lines CKL and CKBL have substantially the same line capacitance, each pad area of pad portions is substantially the same to make line resistances be substantially the same, and additional resistance elements compensate for time constant differences, so that the time constants of the first and second clock signals CK and CKB are substantially same.

Accordingly, the distortion of the first and second clock signals CK and CKB may be minimized to decrease the distortion of the gate signals, so that display defects such as horizontal line defects may be decreased.

Having described exemplary embodiments of the present invention and its advantages, it is noted that various changes, substitutions and alterations can be made herein without departing from the spirit and scope of the invention as defined by appended claims.

What is claimed is:

1. A display panel comprising:

an array substrate including gate lines and source lines, a gate driving part outputting gate signals to the gate line, and first and second clock lines connected to the gate driving part to respectively transmitting first and second clock signals to the gate driving part, the first and second clock lines connected to the gate driving part having substantially the same length; and an opposite substrate combined with the array substrate and including a common electrode layer, wherein a first time constant of the first clock signal and a second time constant of the second clock signal are substantially the same, and wherein the first clock signal and the second clock signal are transmitted to the same gate driving part.

2. The display panel of claim 1, wherein a first line resistance of the first clock line and a second line resistance of the second clock line are substantially the same.

3. The display panel of claim 2, wherein a first line capacitance of the first clock line and a second line capacitance of the second clock line are substantially the same.

4. The display panel of claim 3, wherein the common electrode layer has an opening portion patterned to expose the first and second clock lines, and exposed portions of the first and second clock lines have substantially the same area.

5. The display panel of claim 4, further comprising a sealant formed around the array substrate to combine the array substrate with the opposite substrate, wherein areas of the first and second clock lines covered by the sealant are substantially the same.

6. The display panel of claim 3, further comprising a sealant formed around the array substrate to combine the array substrate with the opposite substrate, wherein areas of the first and second clock lines covered by the sealant are substantially the same.

7. The display panel of claim 2, further comprising first and second pad electrodes respectively formed at end portions of the first and second clock lines on the array substrate, wherein areas of the first and second pad electrodes are substantially the same.

8. The display panel of claim 1, wherein a first line capacitance of the first clock line and a second line capacitance of the second clock line are substantially the same.

9. The display panel of claim 8, wherein the common electrode layer has an opening portion patterned to expose the first and second clock lines, and exposed portions of the first and second clock lines have substantially the same area.

10. The display panel of claim 9, further comprising a sealant formed around the array substrate to combine the array substrate with the opposite substrate, wherein areas of the first and second clock lines covered by the sealant are substantially the same.

11. The display panel of claim 8, further comprising a sealant formed around the array substrate to combine the array substrate with the opposite substrate, wherein areas of the first and second clock lines covered by the sealant are substantially the same.

12. The display panel of claim 1, wherein the gate driving part comprises:

a first gate driving part formed in a first peripheral area adjacent to a first end portion of the gate lines to output the gate signals to the gate lines; and a second gate driving part formed in a second peripheral area adjacent to a second end portion of the gate lines to output the gate signals to the gate lines.

* * * * *